United States Patent [19]

Grey

[11] 4,273,661

[45] Jun. 16, 1981

[54] ARTICLE FOR DISPENSING LIQUID BLEACH SOFTENER COMPOSITION

[75] Inventor: Seymour Grey, Somerset, N.J.

[73] Assignee: Colgate-Palmolive Company, New York, N.Y.

[21] Appl. No.: 909,331

[22] Filed: May 25, 1978

[51] Int. Cl.[2] ..... D06M 13/34

[52] U.S. Cl. ..... 252/8.8; 8/102; 68/17 R; 206/0.5

[58] Field of Search ..... 252/8.8; 8/102; 68/17 R; 206/0.5

[56] References Cited

U.S. PATENT DOCUMENTS

| | | | |
|---|---|---|---|
| 3,163,606 | 12/1964 | Viveen et al. | 252/102 |
| 3,870,145 | 3/1975 | Mizuno | 206/0.5 |
| 3,896,033 | 7/1975 | Grimm | 252/8.8 |
| 3,945,936 | 3/1976 | Lucas et al. | 252/102 |
| 3,989,638 | 11/1976 | Bradley et al. | 252/186 |
| 4,004,685 | 1/1977 | Mizuno et al. | 206/0.5 |
| 4,113,630 | 9/1978 | Hagner | 252/8.8 |

*Primary Examiner*—William E. Schulz

*Attorney, Agent, or Firm*—Norman Blumenkopf; Herbert S. Sylvester; Murray M. Grill

[57] ABSTRACT

Article for dispensing liquid bleach-softener composition in one or more of the wash, rinse and tumble dry cycles of a fabric laundering process comprising a flexible, form retaining, open cell porous foam substrate, preferably polyurethane, impregnated with a liquid composition containing an effective bleaching and softening amount of water soluble peroxy bleaching agent and water soluble softener, at least 50% by weight of the softener being cationic imide of the imidazolinium or pyridinium type in a weight ratio of softener to bleach of about 5:7 to 5:1.

13 Claims, No Drawings

ARTICLE FOR DISPENSING LIQUID BLEACH SOFTENER COMPOSITION

FIELD OF INVENTION

The invention relates to an article for dispensing a liquid, bleach softener composition in one or more of the wash, rinse and tumble dry cycles of a fabric laundering process and particularly to such an article capable of efficiently and uniformly dispensing the liquid bleach softener composition in predetermined amounts over the optimum portion of the adding cycle.

BACKGROUND OF THE INVENTION

Description of the Prior Art

Conditioning compositions heretofore provided in the art for the treatment of fabrics in one or more cycles of an automatic laundering process usually include, regarding softening and bleaching in particular, either a bleaching or softening agent.

Combination of these materials in a unitary composition is at best but vaguely suggested as regards specific types of ingredients, proportions and the like. Moreover, in such cases, it is indicated as being necessary to use the bleach material in dry form, and in substantial excess on a weight basis with respect to any softener compound which might be peripherally included within the relevant teaching. Peroxygen bleaches in such cases are usually limited to the normally solid, water-soluble type such as the alkali metal and ammonium perborates, percarbonates, mono-persulfates and monoperphosphates, species of the foregoing including for example sodium and potassium perborates and percarbonates. The aforementioned normally solid, inorganic peroxygen bleaches are usually employed in combination with various types of solid activators such as those disclosed in U.S. Pat. No. 3,130.165.

U.S. Patents relevant to the foregoing discussion include U.S. Pat. Nos. 3,945,936; 3,870,145; 3,994,694; 3,956,556; 3,634,947; 3,947,971 and 3,283,357.

The bleach component is usually added to the washing or drying cycle in solid form as described in U.S. Pat. No. 3,945,936 and British Pat. No. 1,456,592. It is recognized that wash cycle bleach compositions in liquid form are currently being marketed; however, such compositions do not include, nor is provision made for the inclusion of softener.

Softener compounds on the other hand, are conventionally added to the laundering process suitably dispersed in a liquid carrier, which may in turn be incorporated, e.g., by impregnation into a solid carrier support. Relevant in this regard are U.S. Pat. Nos. 3,442,692 and 3,632,396 describing the incorporation of liquid solutions or dispersions of softener e.g., quaternary ammonium compounds, into an absorbent sponge type substrate and substrates of open pore structure from nonwoven cloth paper, etc. of various shapes such as puffs, balls and the like. Other U.S. Patents relevant to softener materials and structures for their dispensing in a laundering process include U.S. Pat. Nos. 3,870,145; 3,944,694; 3,956,556; 3,634,947; 3,947,971; 3,442,692 and 3,632,396.

Conditioning compositions in liquid form offer several advantages such as, ready dissolution or dispersion in the washing medium or damp fabrics in the laundry dryer, homogeneity via solubilization of solid and/or liquid components in the conditioner solvent, facility of dispensing, e.g. by simple pouring enhanced accuracy of predetermined dosage amounts due to the increased volume of conditioner solution being handled by the user, etc. By way of contrast, the use of solid conditioning compositions entails significant disadvantages such as the rather elaborate and cumbersome structures required for their efficient dispensing in the machine as well as the difficulties inherent in the compounding of solid ingredients in the form of a coherent, homogeneous mass having adequate structural as well as chemical stability.

Moreover, conditioning compositions thus far provided but a single function, e.g. bleaching or softening, requiring therefore, the use of separate compositions during the washing-drying process according to a predetermined sequence of addition. The inconvenience to the user is readily apparent.

Thus, in copending application (filed simultaneously herewith) there are described liquid bleach-softener compositions capable of providing simultaneous bleaching, softening, detergency, antistat properties, etc., when added to one more of the wash, rinse and dryer cycles of an automatic machine laundering process. The result is considered surprising since it would normally be expected that problems associated with, for example, compatibility and stability of the involved ingredients and particularly in a liquid environment normally considered to be highly conducive to undesired fugitive side reactions, would militate against any possible effectiveness. Thus, prior art attempts to combine softener and bleach in a single composition have stressed the requirement for solid rather than liquid vehicles and even then under relatively stringent limitations as regards mutual proportions of active ingredients, assuring for example, the presence of bleach in at least substantial excess over softener. Thus, the recognized tendency of many softeners to form insoluble gels when present together with a peroxy bleaching agent in an aqueous medium is a significant factor in the compounding of such composition.

A wide variety of solid carried for conditioning compositions of the aforementioned type are discussed in the prior art ranging from non-woven cloth to open pore or open cell type flexible foam materials usually prepared from synthetic polymeric substances such as those based on polyurethanes. Although this type of substrate has been impregnated with various types of fabric conditioning compositions to provide convenient dispensing means for use in the appropriate cycle of the laundering process, the impregnating composition is invariably limited to the bleach or softener type. This apparently obtains in deference to the what would normally be expected unstable nature of the peroxide bleach in an aqueous environment in the presence of other oxidizable materials. The use of porous foam type carriers or substrates for such compositions would likewise be contraindicated since any unstable peroxide behavior might well be exascerbated by intimate confinement within a structure which could serve as a supply of sites or loci for degradative oxidation. This is particularly the case where extended storage periods under even ambient temperatures might be contemplated.

Consequently, in those instances where compositions combining peroxy bleach and softener are even remotely contemplated, it is required that such compositions be in dry form for introduction to the carrier substrate. The disadvantages here are numerous. As is commonly recognized, for optimum bleaching effects, it is necessary that the bleach composition be added to an aqueous environment. Addition to the wash cycle presents little problem; however, when added to the dryer substantially all of the bleach composition must be released during the initial phase of the drying cycle to insure the presence of sufficient moisture from the damp laundry to supply a reaction medium for the bleach. With solid bleach compositions, special precautions must be taken in fabricating the carrier substrate to guard against tardy release of the composition. Usually, the composition is sealed within a cavity provided in the substrate, the latter being, for example, an open pore cellular polymeric foam such as polyurethane. The tumble action of the dryer forces the composition to sift through the porous carrier for contact with the damp fabrics. In such structures, the particle size of the conditioning composition must be rigorously controlled vis-a-vis the average pore diameter of the substrate so that the dry composition is able to gravitate or sift through the structure for release to the damp fabrics. Moreover, as stated, this must occur during the initial portion of the dryer cycle. If conditioner release is too rapid, uneven deposition of the conditioner to the fabric usually occurs. On the other hand, should release be too slow, a portion of the composition may remain in the dry state, i.e. non-dissolved due to inadequate moisture, and be lost by venting from the dryer or alternatively, appear as an undesirable dust deposit on the fabrics.

Thus, a primary object of the invention is to provide an article for dispensing of liquid bleach softener composition wherein the foregoing and related disadvantages are eliminated or at least mitigated to a substantial extent.

A further object of the invention is to provide such an article capable of providing effective bleaching and softening when added to one or more of the wash, rinse and drying cycles of a fabric laundering process.

A still further object of the invention is to provide such an article capable of dispensing effective amounts of bleach softener composition during the optimum portion of the laundering cycle, release of composition being initiated by tumbling action.

Yet a still further object of the invention is to provide such an article wherein problems associated with loss of composition by dusting, and undesired spotting of fabrics by dust residues are eliminated.

Another object of the invention is to provide such an article having good compatibility with the bleach-softener ingredients and thus improved stability over prolonged periods of time at ambient and elevated temperatures.

Still another object of the invention is to provide such an article completely safe for use with dyed synthetic fabrics, such as Dacron, Dacron-cotton, permanent press as well as natural fibers.

Yet another object of the invention is to provide such an article of relatively simple construction, thus enabling more economical mathods of manufacture.

Another object of the invention is to provide a process employing such article in the conditioning of fabrics in a laundering process.

Other objects and advantages of the invention will become more apparent hereinafter as the description proceeds.

DETAILED DESCRIPTION OF THE INVENTION

The attainment of the foregoing objects is made possible which in its broader aspects includes an article for dispensing liquid bleach softener composition in one or more of the wash, rinse and tumble dry cycles of a fabric laundering process comprising a porous flexible, form retaining, open cell polymeric foam substrate impregnated with an effective bleaching and softening amount of a liquid composition consisting essentially of by weight from about 3 to 10% of water-soluble peroxy bleaching agent, at least about 50% thereof being hydrogen peroxide and from about 3 to 25% of water soluble fabric softener compound at least about 50% thereof being cationic amine softener, the weight ratio of softener to peroxy bleach being from about 5:7 to 5:1, the balance of said composition being water alone or combined with water miscible lower alkanol.

In a further aspect, the invention includes a process of conditioning fabrics by simultaneous bleaching and softening thereof comprising treated said fabrics in one or more of the wash, rinse and tumble drying cycles of a laundering process with the aforedescribed article.

The polymeric substrates herein which serve as the carrier for the impregnating bleach softener composition can be selected from a relatively wide variety of materials including, for example, polystyrene, polyethylene and the like. The material selected should be relatively form retaining, i.e. dimensionally stable, flexible with good elastic return properties enabling repeated flexing thereof. The term "open pore" is used in its conventional and art recognized sense and delineates cellular foam materials having a plurality of fine pore openings which make up a rete network of intercommunicating cells. This insures a uniform and controlled migration of bleach softener composition outwardly of the article when subjected to physically deformed forces such as the shear and compression forces encountered in tumble dryer. The articles have a relatively high "void" or "free space" volume allowing substantial impregnation thereof, with pore size usually ranging from about 25 to 200 microns. Polymeric open cell foams are more often characterized in terms of their density per cubic foot which, or course, is a direct function of the average pore size thereof. Thus, a given density will usually indicate the pore size of the foam. Particularly, effective foam materials for use herein have a density of from about 0.7 to 1.6 lbs./cubic foot.

In accordance with a preferred embodiment, the open cell polymeric foam is of the polyurethane, polyurethane ether type. These materials are well-known in the art and are readily available commercially in a wide range of densities and thus pore size. These polymers are usually prepared by the reaction of one or more polyisocyanates in known manner with a suitable condensing agent. The products have good absorbency, flexibility and dimensional stability. Preferred herein are the polyurethane foam materials commercially available from Tenneco, these being found to be particularly effective from the standpoint of resistance to heat and oxidation, and particularly under the moisture and temperature conditions prevailing in the laundry dryer during operation. One of the truly surprising features of the invention relates to the fact that the polyurethane foam is completely compatible with peroxy bleach-softener composition. As mentioned, hydrogen peroxide in particular would ordinarily be thought of as being highly oxidative in an aqueous environment and in the presence of oxidizable materials such as the instant softener and polyurethane. Despite impregnation of the polyurethane foam with substantial quantities of the instant bleach-softener composition, polyurethane-bleach composition compatibility and stability are excellent. Results to be demonstrated indicate relatively negligible loss of peroxide despite prolonged standing periods at temperatures normally incident to storage.

The dispensing article may be of any suitable shape such as rectangular, oval, etc., with the former being preferred. Since the ordinary wash load is about 5 to 8 lbs., it is usually found that from about 10 to 60 grams and preferably 10–25 grams of instant bleach-softener composition are more than adequate to effectively negotiate the softening and stain removal problem at hand. This corresponds to a range of bleach and softener of from about 0.3 to 6 grams of bleaching agent and 0.3 to 15 grams of softener. For such purposes, the thickness of the foam substrate may range from about 1/16" to ½ inch. Typical dimensions of foam substrates herein are as follows: 4×8×¼ inches; 4½×6½×¼ inches, 5×6×¼ inches and 8×10×⅛ inches. All are capable of efficiently accommodating at least the amounts of bleach-softener composition previously defined.

The dispensing articles herein described are most conveniently supplied disposed within a suitable pouch container. The pouch should be fabricated of material capable of acting as an effective moisture barrier, and particularly at higher temperature on the order of 100°–110° F. Particularly effective in this regard is a foil polyethylene such as the product commercially available as Alure HD which is metallized mylar/polyethylene. For further convenience to the user, a suitable tab or handle portion may be provided on the substrate, thus minimizing the necessity for direct contact with the article.

The bleach softener impregnating compositions for use herein are described in copending application (filed simultaneously herewith) entitled Liquid Bleach-Softener Compositions and having the same inventorship as the present application. The application describes in detail addition of the bleach-softener composition to the laundering process by simple pouring or by means of a HANDIWIPE TM impregnated with the liquid bleach softener. The use of the instant polyerethane article, in addition to providing at least equal bleaching and softening results, affords much more effective means for assuring material release of the composition over the appropriate portion of the laundering cycle in question. Moreover, due to the flexible, spongy structure of the polyurethane article, the included composition is released substantially to the point of exhaustion, thereby maximizing retrieval of bleach-softener product for the target purpose cloth type substrates not being form retaining and being totally lacking in elasticity may tend to become entangled with the fabric being treated and fold upon itself reducing efficient release over its entire extent.

As described in copending application filed simultaneously, at least about 50% and more preferably at least about 75%, of the peroxy bleaching agent is hydrogen peroxide. Hydrogen peroxide is somewhat unique and atypical within the broad class of known peroxy bleaches, exhibiting a highly satisfactory level of stability when exposed to varying conditions of temperature despite the presence of the softener compound and polyerethane material. Moreover, the bleaching activity of the hydrogen peroxide and thus its ability to remove oxidizable stains from treated fabrics is apparently unaffected by the softener compounds and polyurethane despite their prolonged periods of contact at elevated temperatures. e.g. up to about 110° F. The stable condition obtains despite as previously mentioned the recognized activity of hydrogen peroxide in aqueous media and especially in the presence of compounds capable of undergoing oxidation. Hydrogen peroxide is generically supplied commercially in the form of an aqueous solution such as the 50% solution available on the market as Albone 50% CG. Other water soluble peroxygen bleaching agents useful herein in combination with the hydrogen peroxide include, without limitations, the inorganic peroxy compounds such as the alkali metal and ammonium perborates, percarbonates, monopersulfates and monoperphosphates in their various hydrated forms. Specific examples are sodium and potassium perborates, sodium and potassium percarbonates and the like. Other useful materials include the water soluble organic peroxy acids and/or the water soluble salts, e.g. alkali metal salts, thereof such as described in U.S. Pat. No. 3,749,673; the mixtures of organic peroxy acids and persulfate bleaches described in U.S. Pat. No. 3,773,673. Activators for one or more of the aforementioned bleaching materials may also be used in known manner such as described in U.S. Pat. Nos. 3,130,165 and 3,945,936. As indicated, the amount of auxiliary bleaching agent is less than about 50% and preferably less than about 25% of the total bleach employed. It will further be understood that any such auxiliary bleach or amounts thereof having an adverse effect upon the composition in terms of stability, functionality, and the like are excluded as to such amounts and types. In any event, in accordance with the highly preferred embodiment of the invention, the bleach component is solely hydrogen peroxide.

The concentration of peroxy bleach in the composition is from about 3 to 10% by weight with a range of 4 to 8% being preferred, the value selected being such as to provide a softener: bleach weight ratio in the final composition of from about 5:7 to 5:1. Within the range given, the specific amount selected mainly has reference to the severity of the laundering problem contemplated for the product composition.

Softener compounds for use herein fall into the general category of cationic amines, this term intended to cover cationic imides as well. Thus, softeners of the aliphatic quaternary ammonium type as well as cyclic imides are included such as the imidazolinium and pyridinium salts. In general, the aliphatic quaternary ammonium softeners can be represented according to the following structural formula:

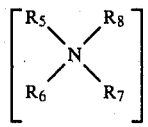

wherein $R_5$ is an aliphatic, e.g. alkyl, group of from 12 to 22 and preferably carbon atoms; $R_6$ is an aliphatic e.g. alkyl, group of from 1 to 22 carbon atoms and $R_7$ and $R_8$ are each lower alkyl groups of 1 to 4 and preferable 1 to 3 carbon atoms, and X is a water-soluble salt forming anion such as a halide, i.e., chloride, bromide, iodide; a sulfate, acetate hydroxide, methosulfate or similar inorganic or organic solubilizing mono-or dibasic radical. Examples of quaternary ammonium softeners useful herein include, without necessary limitation, hexadecyltrimethyl ammonium bromide, this being a particularly preferred species; hydrogenated ditallow dimethyl ammonium chloride; ethoxylated (n=3) distearyl methyl ammonium chloride; dihexadecyl dimethyl ammonium chloride; dieicosyl dimethylammonium chloride; didocosyl dimethyl ammonium chloride; dihexadecyl diethyl ammonium chloride; dihexadecyl dimethyl ammonium acetate; ditallow dimethyl ammonium nitrate; etc.

Another and preferred class of cationic nitrogen softener for use herein are the imidazolinium salts which can be represented according to the following structural formula:

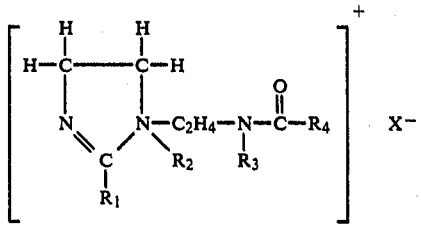

wherein $R_1$ is alkyl of from 8 to 25 carbon atoms; $R_2$ is alkyl of from 1 to 4 carbon atoms; $R_3$ is hydrogen or alkyl containing from 8 to 22 carbon atoms: $R_4$ is hydrogen or alkyl of from 1 to 4 carbon atoms and X is an anion having the aforedefined significance. Examples of compounds within the above formula are: 1-methyl-1-(tallowamido-ethyl)-2-tallow imidazolinium methyl sulfate, this being a particularly preferred species and available commercially as Varisoft 475 softening agent; 2-heptadecyl-1, 1-methyl[(2-stearoylamido)ethyl-]imidazolinium methyl sulfate. Compounds particularly preferred herein are those within the above formula wherein $R_1$ and $R_3$ are alkyls of from about 12 to 22 carbon atoms.

Another preferred class of softening agents for use herein are the alkyl ($C_{12}$ to $C_{22}$) pyridinium chlorides and alkyl ($C_{12}$ to $C_{22}$)-alkyl ($C_1$ to $C_3$)-morpholinium chlorides. A particularly preferred species of this type of softener is cetyl pyridinium chloride (monohydrate).

The softener compound above described may be employed singly or in admixture comprising two or more thereof and in a total concentration of from about 3 to about 25% by weight of product composition. The value selected is such as to provide a softener: peroxy bleach weight ratio of from about 5:7 to 5:1 as previously mentioned. The indicated amounts of softener and bleaching agent, as regards total concentration in the product composition are such as to provide effective softening and bleaching having reference to the wide disparity in the severity of the cleaning problems normally encountered with bond synthetic type and natural fabrics.

It will be understood that the foregoing formulae are used to define preferred classes of softener and are not to be considered as limitative. Thus, in accordance with preferred practice, softeners comprising cationic nitrogen compounds of heterocyclic structure, i.e., the cationic imides are generally useful herein. Those compounds within the formulae given are those generally found to assure optimum results in accordance with the objectives of the present invention.

The aforedescribed softeners constitute at least about 50% and preferably at least about 75% of the total softener used. In accordance with a highly preferred embodiment, such softeners comprise the sole softener component. Auxiliary softeners useful herein are well known in the art and may, in general, be selected from a relatively wide variety of materials. Examples include, without necessary limitation, (a) the zwitterionic quaternary ammonium compounds such as 3-(N-eicosyl-N,N-dimethylammonio)-2-hydroxypropane-1-sulfonate; 3-(N-eicosyl-N,N-dimethylammonio)propane-1-sulfonate; 3-(N-docosyl-N,N-dimethylammonio)-2-hydroxypropane-1-sulfonate; 3-(N-tetracosyl-N,N-dimethylammonio)-propane-1-sulfonate; 3-(N-hexacosyl-N,N-dimethylammonio)-2-hydroxypropane-1-sulfonate and the like; (b) nonionic tertiary phosphine oxide such as eicosyldimethylphosphine oxide; dicosyldi(2-hydroxyethyl)phosphine oxide; hexacosyldimethylphosphine oxide; dicosyldiethylphosphine oxide; eicosylmethylethyl-phosphine oxide; tricosyldiethylphosphine oxide; pentacosyldimethyl phosphine oxide; heptacosyldimethyl-phosphine oxide and the like; (c) nonionic tertiary amine oxides such as eicosyl-bis-(B-hydroxyethyl)amine oxide; docosyldimethylamine oxide; tetracosyldimethylamine oxide; 2-hydroxyeicosyldi(ethyl)amine oxide; tricosyldimethylamine oxide; tetra-cosyldiethtylamine oxide and the like; (d) nonionic ethoxylated alcohol compounds generally comprising the reaction product of $C_{20}$–$C_{30}$ alcohols with from 3 to 45 moles ethylene oxide; (e) ethoxylated alcohol sulfates comprising the sulfated condensation products of $C_{20}$–C30 alcohols with 1–20 moles of ethylene oxide; (f) $C_8$–$C_{20}$ alkyl sulfate anionic synthetic detergents; (g) ampholytic synthetic detergents, softeners of the aforedescribed types being more fully described, for example in U.S. Pat. No. 3,843,395. Again, softener materials or amounts thereof which materially adversely affect the stability or functionality of the product composition are excluded herein as to such types and/or amounts.

Softener materials particularly preferred for use herein comprise the cationic nitrogen softeners of the heterocyclic imide type, the preferred materials within this class being the imidazolinium and pyridinium salts as previously described. It appears that these materials exhibit greater stability on standing and particularly at elevated temperatures when compared to softeners of the aliphatic quaternary ammonium type.

The excellent stability and compatibility of the aforedescribed compositions with polymeric cellular foam substrates is demonstrated by the following. Age testing is carried out in sealed glass jars at a temperature of 100° F. for the time periods indicated. The test materials comprise in each case a rectangular specimen of polyurethane open cell foam substrate having a density of about 1.2 lbs/cubic foot and measuring 4×4×¼ inches. The amount of composition impregnated into the test specimens are respectively 30 and 60 gm. The bleach-softener compositions tested are as follows:

| A | |
|---|---|
| Ingredient | % by weight |
| hydrogen perioxide (Albone 50% CG) | 12.0 |
| [1]Varisoft 475 | 6.7 |
| Deionized water | 81.3 |

-continued

| Ingredient | A % by weight |
|---|---|
| | 100.0 |

pH adusted to 4.5 with 25% $H_2SO_4$
[1]1-methyl-1-(tallow amidoethyl)-2-tallow imidazolinium methyl sulfate; 75% A.I. = 5% softener

| Ingredient | B % by weight |
|---|---|
| hydrogen peroxide (Albone 50% CG) | 12.0 |
| Varisoft 475 | [2]13.3 |
| Deionized water | 74.7 |
| | 100.00 |

[2]to provide 10% softener

The results are summarized as follows:

TABLE I

| Composition | Grams | initial $H_2O_2$ concentration = 6.2% % $H_2O_2$ remaining after: months 1 | 2 |
|---|---|---|---|
| A | 30 | — | 5.7 |
| A | 60 | 6.0 | 5.8 |
| B | 30 | 5.9 | 5.8 |
| B | 60 | — | 5.7 |

The foregoing is repeated but increasing the net softener concentration to 20% to provide a softener: bleach weight ratio of about 3.3:1 replacing part of the water with isopropanol (6% of total composition). The test specimens comprise polyurethane open cell foam having a density of about 1.3 lbs/cubic foot measuring 4×8×¼" and impregnated with 15 grams of the bleach softener composition. The results are as follows:

TABLE II

| Months | initial $H_2O_2$ concentration = 6.4% % $H_2O$ remaining R.T. | 100° F. |
|---|---|---|
| 2 | 6.3 | 5.5 |
| 3 | 6.1 | 4.7 |
| 4 | 5.9 | 3.5 |

Stability of the hydrogen peroxide is excellent at around room temperature, approximately 90% thereof remaining after 4 months. Significant loss of hydrogen peroxide does not occur until after approximately 3 months of aging at 100° F. Stability at the higher temperature can be improved, especially where extended storage is probable, by the use of known hydrogen peroxide stabilizers such as ethylene diamine tetraacetic acid (EDTA). Under the aforedescribed testing conditions, only negligible loss of softener occurred.

Similar results are obtained when the above tested softeners are replaced wholly or in part by other of the primary softeners and the pyridinium compounds hereinbefore given. Partial substitution of the primary softener and $H_2O_2$ with the auxiliary materials previously described tends to diminish the stability of the article and particularly when such replacement is on the order of 50% and higher.

In such cases, the use of hydrogen peroxide stabilizers such as the previously mentioned EDTA tends to promote stability.

Most desirably the pH of the liquid, bleach fabric softener compositions should be maintained on the acid side, e.g. from about 4 to 5, with a range of 4.3 to 4.7 being particularly effective. The acid pH appears to assure not only good composition stability but bleach and softener effectiveness as well. In addition, more favorable effects as regards the detergency and antistatic properties obtain at the acid pH. The acid pH assumes even greater importance as the concentration of the peroxy and softener compounds in the composition is increased within the limits hereinbefore given, i.e. $H_2O_2$ concentrations of up to about 10% and softener concentrations of up to about 25%.

The softener and bleaching agents for use herein function to exceptional advantage each contributing their respective properties to a significant extent in the laundering process, their being no appreciable evidence of undesired bleach softener interaction or performance-inhibiting effects. Thus, their respective utilities are substantially retained within the foam carrier environment. The latter supplies, in effect, a vast network of capillary type channels and in effect, a vast surface area normally conducive to chemical interaction such as oxidation. However, such is not the case, testing indicating the present articles to be at least as effective as commercial composition as regards softening and removable of oxidizable stain. Moreover, these results obtain when comparative testing is carried out in the dryer as well as wash cycles of an automatic washing machine. As will be evident from the examples to be hereinafter given, the advantages of the liquid, bleach-softener composition described in copending application are fully retained in all aspects despite their incorporation into the open cell polymeric foam material. Moreover, these advantages are evident with respect to colored synthetic fabrics as well as natural fabrics, indicating the present impregnated substrate article to be completely safe for a wide spectrum of uses.

For optimum results, it is usually recommended that the softener concentrations within the higher portion of the range hereinbefore given (eg. on the order of 10–20% be used should the instant composition be intended for use in the dryer. The instant articles are particularly advantageously adapted for such use since they assure relatively quick dispersion of the composition onto the damp fabrics while sufficient moisture is present thereby promoting uniform stain removal as well as softening. However, it should be understood that even at the lower softener concentration, the instant articles compare well with the commercial formulae as the examples well make clear.

In some cases, slight gel formation may be observed either in formulating the instant compositions or during or after impregnation with the use of the higher levels (on the order of 25–50%) of auxiliary softener. This can be remedied by the use of small amounts of thinning agent such as NaCl, $NaNO_3$ and the like.

The instant bleach softener article is most effectively used by merely placing same in the machine at the outset of the wash, rinse and/or drying cycle. The article, is commingling with the fabrics, is subjected to deforming forces causing the liquid bleach softener composition to be released. As previously pointed out, for most laundering applications, the foam substrate should be impregnated with about 10 to 25 grams of bleach softener composition with a range of 10 to 20 grams being preferred. The amount should be in any event be effective as mentioned hereinbefore.

The term effective amount is to be accorded its conventional and art-recognized significance in connoting an amount sufficient to soften and stain-clean the fabric being treated. It is appreciated that the severity of the stain removal problem, eg., tea and wine stains may necessitate the use of greater "effective" amounts. The term "effective" is to interpreted having reference thereto. In any event for the vast majority of laundering applications, sufficient of the bleach softener composition should be impregnated into the foam substrate to provide a concentration in the wash medium of at least about 100 to 150 ppm.

The following examples are for purposes of illustration only and are not to be interpreted as necessarily constituting a limitation on the invention. All parts are by weight unless otherwise given. Detergent where used has the following composition unless otherwise indicated.

Detergent A

10% Sodium linear tridecyl benzene sulfonate
2% $C_{14}$–$C_{15}$ fatty alcohol with an average of 11 ethylene oxide groups
2% mixed sodium coconut/tallow fatty acid
35% pentasodium tripolyphosphate
7% sodium silicate ($Na_2O$: $SiO_2$ ratio 1:2.35
0.5% sodium carboxy methyl cellulose
balance sodium sulfate Example I compares the instant impregnated article, when added to the dryer cycle, against a commercial hydrogen peroxide bleach, when added to the wash cycle, in terms of stain removal.

EXAMPLE 1

Rectangular specimens of open cell polyurethane foam having a density of about 1.2 lbs/cubic feet and measuring 4×8×¼", 4½ c 6½ c ¼" and 5×6×¼" respectively are each impregnated with 30 grams of the following composition:

| Ingredient | % by weight |
|---|---|
| Varisoft 475 | 13.3 |
| Hydrogen peroxide (Albone 50% CG | 12.0 |
| Deionized water | 74.7 |
| | 100.0 |

to provide 1.8 g $H_2O_2$ and 3.0 g of softener. Testing is carried out by adding each of the test specimens to a laundry dryer containing 6 lbs. of damp, spun-dried fabrics comprising Dacron-cotton, permanent press (50/50) stained with tea, grape juice and wine, respectively. Drying is carried out for 1 hour at a temperature ranging from 150° F.–170° F.

Testing the commercial bleach comprising 6% hydrogen peroxide is carried out by adding (pouring) 120 grams thereof (7.2 grams $H_2O_2$) to the wash cycle of the washing machine using 100° F. tap water containing 6 lbs of identically stained fabric. Stain removal is determined by reflectance readings taken according to standard techniques before and after fabric treatment and are reported as Rd. The results are as follows:

TABLE III

| Stain | Commercial Bleach | Impregnated polyurethane 4 × 8 × ¼" | 4½ × 6½" | 5 × 6 × ¼" |
|---|---|---|---|---|
| Tea | 4 | 10 | 10 | 8 |
| Grape Juice | 35 | 40 | 42 | 40 |
| Wine | 32 | 34 | — | — |

The polyurethane article provides markedly superior tea and grape juice stain removal and somewhat lesser improvement with respect to wine stain removal. These improvements obtain despite the use of commercial bleach in amounts providing a substantial excess of hydrogen peroxide over the polyurethane composition (4:1). Even allowing for the reduced relative concentration of hydrogen peroxide in the wash medium due to the relatively large volume of water, the superior stain removal of the articles provided by the present invention is clearly evident.

EXAMPLE 2

The procedure of example 1 is repeated except that the polyurethane articles are tested against a commercial softener also added by pouring to the dryer cycle in amounts providing 3.0 grams of softener. The test fabrics comprise Terry Towels. When tested for softness by a panel of five independent judges, the assigned softness ratings on a scale of 1 to 5 indicate the polyurethane article to provide softness equal to that of the commercial softener product.

EXAMPLE 3

Example 1 is repeated except that the concentration of Varisoft softener in the polyurethane run is increased to 26.6% to provide a net softener concentration of 20%. The stain removal superiority of the polyurethane run is similar to that of Example 1. Again, softness is at least equal to the commercial softener product with regard to test specimens to Terry Towel cloth.

EXAMPLE 4

Example 1 is repeated except that the concentration of Varisoft is decreased to 6.7% to provide a net softener concentration of 5.0%, or 1.5 grams.

TABLE IV

| | | Δ Rd | | |
|---|---|---|---|---|
| Stain | Commercial Bleach | Impregnated polyurethane 4 × 8 × ¼" | 4½ × 6½ × ¼" | 5 × 6 × ¼" |
| Tea | 5 | 12 | 12 | 10 |
| Grape | 37 | 46 | 47 | 45 |
| Wine | 30 | 34 | — | — |

As the data indicates, the dryer added impregnated polyurethane provides markedly superior strain removal in comparison to the commercial bleach. Though containing but 1.5 gram of softener, the softness rating of Terry Towels treated with the polyurethane element is only slightly less than that obtained with a commercial softener containing 3.0 grams of softener.

EXAMPLE 5

Example 4 is repeated except that the polyurethane article is impregnated with 60 grams of the bleach softener composition of example 4 to provide 3.6 grams $H_2O_2$ and 3.0 grams softener. The results obtained are as follows:

TABLE V

| Stain | Commercial Bleach | Δ Rd Impregnated polyurethane 4 × 8 × ¼" | 4½ × 6½ × ¼" | 5 × 6 × ¼" |
|---|---|---|---|---|
| Tea | 5 | 14 | 14 | 13 |
| Grape | 37 | 46 | 46 | 45 |
| Wine | 40 | 34 | — | — |

The polyurethane element, again provides superior stain removal with respect to tea and grape stain. Terry Towels treated with the polyurethane element in the dryer are at least equal in softness when compared to a commercial softener also containing 3.0 grams of softener.

EXAMPLE 6

The polyurethane article is tested against a commercial chlorine bleach and a hydrogen peroxide bleach as follows: Dacron-cotton permanent press (50/50) test fabrics are treated in separate runs in the wash cycle with, respectively, a commercial shlorine bleach and a commercial hydrogen peroxide bleach added by pouring, using 100° F. tap water. This is compared with runs carried out using identically stained Dacron-cotton permanent press (50/50) test fabrics treated in the dryer, following spin drying, with a polyurethane article measuring 4×8×¼" containing 30 grams (1.8 grams $H_2O_2$; 3.0 grams softener) of the bleach-softener composition of Example 1. Quantities of the commercial bleaches are such as to provide 1.8 grams of bleaching agent. Drying is carried out for 1 hour at 150°-170° F. In all runs, 1¼ cups of detergent A. hereinbefore described, is added to the wash cycle. The results are as follows:

TABLE VI

| Stain | Δ Rd Impregnated Polyurethane | Commercial Chlorine Bleach | Commercial hydrogen peroxide bleach |
|---|---|---|---|
| Tea | 10 | 6 | 4 |
| Grape Juice | 43 | 34 | 32 |
| Wine | 36 | 34 | 32 |

The dryer added polyurethane element provides superior stain removal than either of the washer added commercial bleach compositions.

In the preceding examples, comparisons are given with respect to the use of the polyurethane article in the dryer and commercial bleach compositions in the washer cycle. The present impregnated articles may be added with equal effects to other cycles of the laundering process as the following will demonstrate.

EXAMPLE 7

Example 6 is repeated except that the concentration of Varisoft is reduced to 5% and the polyurethane article is added to the wash cycle instead of the dryer. The results are as follows:

TABLE VII

| Stain | Δ Rd Impregnated polyurethane | Commercial Chlorine bleach | Commercial hydrogen peroxide bleach |
|---|---|---|---|
| Tea | 3.6 | 6 | 4 |
| Grape Juice | 33 | 34 | 32 |
| Wine | 31 | 34 | 32 |

The impregnated polyurethane is about equal to the commercial peroxide bleach and only slightly less effective than the commercial chlorine bleach as regards stain removal. The polyurethane run produces much softer fabrics, however, than either of the commercial bleach runs.

The following example illustrates the present invention as applied to the rinse cycle of an automatic laundering machine.

EXAMPLE 8

60 grams of the following composition

| Ingredient | % |
|---|---|
| hydrogen peroxide (50% Albone CG) | 12.0 |
| Varisoft 475 | 6.7 |
| Deionized water | 81.3 |

is impregnated into an open cell polyurethane substrate having a density of about 0.7 to 1.6 lbs/cubic foot. The article is added to the washing machine immediately upon commencement of the rinse cycle the machine containing test fabrics of Dacron-cotton (50/50) permanent press washed with about 1¼ cup of detergent A using 100° F. tap water. The fabrics are dried in a tumble dryer for for 1 hour at the normal setting.

The foregoing procedure is repeated but replacing the Varisoft composition with a commercial softener composition containing an identical amount of softener, 3.0 grams. Stain removal and softens data are taken as previously described. The results are as follows:

TABLE VIII

| Stain | Δ Rd Impregnated polyurethane | Commercial softener |
|---|---|---|
| Tea | 1.2 | 1.3 |
| Grape Juice | 32 | 27 |
| Wine | 31 | 27 |

The impregnated polyurethane provides superior stain removal as the data demonstrates. Softness ratings taken on the test samples by 5 independent panelists establishes the polyurethane run to provide at least equal softness compared to the commercial softener.

In all of the preceding examples, the pH of the bleach softener composition is adjusted where necessary to about 4.5.

When the procedures of the foregoing examples are repeated but replacing the Varisoft 475 with (a) hexadecyltrimethyl ammonium bromide and (b) cetyl pyridinium chloride (monohydrate) essentially the same results are obtained, i.e., oxidizable stain removal and softness results compare at least equally with the commercial compositions separately provided for such purposes. In most cases, the cetyl pyridinium chloride compositions representative of the cationic cyclic imides for use herein, are superior to the hexadecyltrimethyl ammonium bromide. Similar results are likewise obtained when auxiliary softener and bleaching agent of the type described as used to replace their primary counterparts within the concentration limitations previously defined.

When using higher concentration of softener, eg. on the order of at least around 15%, it is recommended to include a lower alkanol cosolvent with the water in amounts ranging up to about 10% of the composition, e.g. 3–10% to promote uniform solubilization of all ingredients.

It will further be understood that the dimensions of the open cell polymeric foam substrate may be increased to accommodate relatively large quantities of bleach softener composition such as on the order of 120 grams and higher. Preferably, however, it is recommended that the concentration of bleach and softener be increased within the limits given should greater quantities of these components be desired and thus to avoid the use of cumbersome structures.

What is claimed is:

1. An article for dispersing liquid bleach-softener composition in one or more of the wash, rinse and tumble dry cycles of a fabric laundering process comprising a flexible, foam retaining, open cell polymeric foam substrate impregnated with a liquid composition containing an effective bleaching and softening amount of water soluble peroxy bleaching agent and water soluble softener of the quaternary ammonium and/or heterocycle imide type in a weight ratio of softener to bleach of about 5:7 to 5:1, at least about 50% of said peroxy bleach being hydrogen peroxide.

2. An article according to claim 1 wherein said polymeric foam substrate is a polyurethane.

3. An article according to claim 2 wherein said foam substrate has a density of from about 0.7 to 1.6 lbs/cubic foot.

4. An article according to claim 2 wherein said bleach softener composition consists essentially of, by weight, from about 3 to 10% of water soluble peroxy bleaching agent, and from about 3 to 25% of water soluble fabric softener, at least about 50% of said softener being at least one member selected from the group consisting of aliphatic quaternary ammonium and hetercyclic imide softeners.

5. An article according to claim 2 wherein said article is disposed within a water impermeable pouch.

6. An article according to claim 5 wherein said pouch comprises metallized mylar/polyethylene.

7. An article according to claim 2 wherein said softener is cetyl pyridinium chloride.

8. An article according to claim 2 wherein said softener is 1-methyl-1-(tallow amidoethyl)-2-tallow imidazolinium chloride.

9. An article according to claim 2 wherein said softener is an imidazolinium compound of the formula:

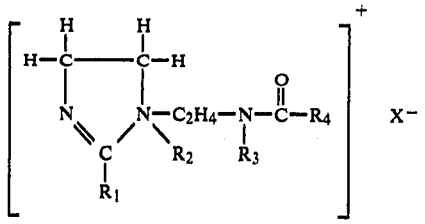

wherein $R_1$ is alkyl of from 8 to 25 carbon atoms, $R_2$ is alkyl of from 1 to 4 carbon atoms, $R_3$ is hydrogen or alkyl containing from 8 to 22 carbon atoms and $R_4$ is hydrogen or alkyl of from 1 to 4 carbon atoms and X is an anion.

10. An article according to claim 2 wherein said softener is an aliphatic quaternary ammonium compound of the formula:

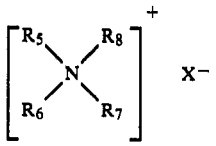

wherein $R_5$ is an aliphatic group of from 12 to 22 carbon atoms; $R_6$ is an aliphatic group having from 1 to 22 carbon atoms and $R_7$ and $R_8$ are each alkyl groups of from 1 to 4 carbon atoms and X is an anion.

11. An article according to claim 2 wherein said softener is a $C_{12}$–$C_{22}$ alkyl pyridinium chloride.

12. An article according to claim 2 wherein said liquid composition has a pH of from about 4 to 5.

13. Process for simultaneously bleaching and softening fabrics which comprises adding to one or more of the wash rinse and frying cycles of a fabric laundering process the composition of claim 1.

* * * * *

UNITED STATES PATENT AND TRADEMARK OFFICE

CERTIFICATE OF CORRECTION

PATENT NO. : 4,273,661

DATED : June 16, 1981

INVENTOR(S) : Seymour Grey

It is certified that error appears in the above—identified patent and that said Letters Patent is hereby corrected as shown below:

Column 11, line 40, "4 1/2 c 6 1/2 c 1/4" should be -- 4 1/2 x 6 1/2 x 1/4 --.

Column 11, line 68, before "Rd" should be -- $\Delta$ --.

Column 12, line 5, "4 1/2 x 6 1/2" should be -- 4 1/2 x 6 1/2 x 1/4 --.

Column 13, line 22, "shlorine" should be -- chlorine --.

Column 14, line 28, erase "for" before -- for 1 hour --.

Column 14, line 33 "softens" should be -- softness --.

Column 16, line 43, "frying" should be -- drying --.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*